US005820816A

United States Patent [19]

Hicks

[11] Patent Number: 5,820,816

[45] Date of Patent: Oct. 13, 1998

[54] PURGING DEVICE AND METHOD OF MAKING SAME

[75] Inventor: James W. Hicks, St. John, Ind.

[73] Assignee: JW Hicks, Inc., Merrillville, Ind.

[21] Appl. No.: 240,261

[22] Filed: May 10, 1994

[51] Int. Cl.[6] ..... C21C 7/00

[52] U.S. Cl. ..... 266/217; 266/268; 264/30

[58] Field of Search ..... 266/216, 217, 266/265, 268, 47; 222/603; 264/30

[56] References Cited

U.S. PATENT DOCUMENTS

| | | | |
|---|---|---|---|
| 4,438,907 | 3/1984 | Kimura et al. | 266/217 |
| 5,104,097 | 4/1992 | Naujokat et al. | 266/217 |
| 5,198,179 | 3/1993 | Bates | 266/217 |
| 5,547,170 | 8/1996 | Angeler et al. | 266/265 |

*Primary Examiner*—Scott Kastler
*Attorney, Agent, or Firm*—Barnes & Thornburg

[57] ABSTRACT

A purging device for use in metal processing includes a shell, a body and a plurality of gas delivery tubes. The body comprises a refractory material and the tubes are disposed therein. Each tube has at least two passageways extending therethrough. The body with the tubes disposed therein is placed in the shell such that there is a gap between a portion of the body and the shell. An inlet allows the device to be attached to a lance, ladle or similar apparatus. Gas flows through the inlet, into the shell, through the passageways in the tubes and into the molten metal. In this manner, gas is delivered through the purging device through a plurality of passages that are arranged in discrete groups.

24 Claims, 2 Drawing Sheets

PURGING DEVICE AND METHOD OF MAKING SAME

BACKGROUND AND SUMMARY OF THE INVENTION

The present invention relates to equipment for processing metals and, in particular, to an improved purging device for delivering gas to molten metals during processing.

When processing molten metal, it is sometimes desirable to introduce gases, such as argon, into the metal. The gases may be introduced for a variety of reasons. For example, they may be used to stir the molten metal so as to distribute alloy materials evenly throughout the metal. Stirring may also be used to homogenize the temperature of the metal. The gases may also be used to change the chemical composition of the metal, thereby changing its mechanical properties as well.

Traditionally, several methods have been used to introduce gases into molten metal. One common way is via a lance or stirring rod. A typical lance is a long metal pipe covered with refractory material. The lance is inserted into a vessel containing molten metal. Gas is forced through the lance and into the metal.

If the molten metal is being transported by a ladle, the lance may be inserted into the metal contained in the ladle. Alternatively, the ladle may be provided with an opening in the bottom or side through which the gas may be introduced into the metal. Similarly, it may be desirable to introduce gases into a smelting furnace through such an opening.

During processing, it may be necessary to interrupt the flow of gas into the metal. If so, the molten metal must be prevented from flowing into the lance or opening in the ladle or furnace. Accordingly, various gas purging devices have been developed. Such devices are typically in fluid communication with the interior of the lance or are placed in the opening in the ladle or furnace, where gas can flow through the device and into the molten metal. However, the openings in the device which allow gas to pass therethrough are typically of a dimension such that the surface tension of the molten metal across the openings prevents the molten metal from flowing into the openings when the gas flow is interrupted.

Additionally, the high temperature and harsh conditions under which metal processing typically occurs adversely affects the processing components. Thus, the purging devices must be able to withstand such conditions for a useful period of time.

Accordingly, it is an object of the present invention to provide an improved purging device for use in metal processing.

Another object of the present invention is the provision of a purging device for use in metal processing to prevent molten metal from flowing into and clogging the gas delivery system.

Still another object of the present invention is the provision of a purging device that is relatively inexpensive and easy to manufacture.

These and other objects of the present invention are attained by the provision of a purging device having a shell, an inlet in fluid communication with the interior of the shell and a body disposed in the shell interior. At least one gas delivery tube is disposed in the body. The tube has at least two passageways extending therethrough.

Other objects, advantages and novel features of the present invention will become apparent when considering the following detailed description of the preferred embodiments and accompanying drawings.

DETAILED DESCRIPTION OF THE PREFERRED EMBODIMENTS

Figure 1:
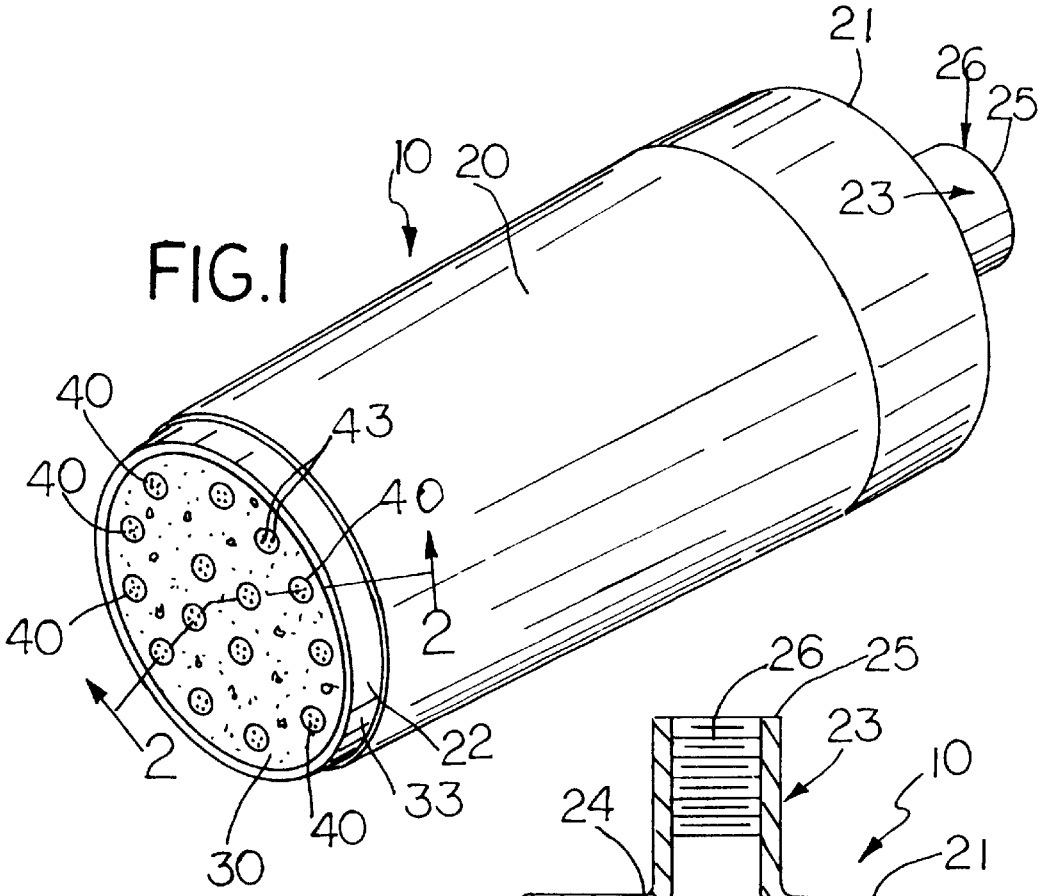
FIG. 1 is a perspective view of a purging device according to the present invention.
Figure 2:
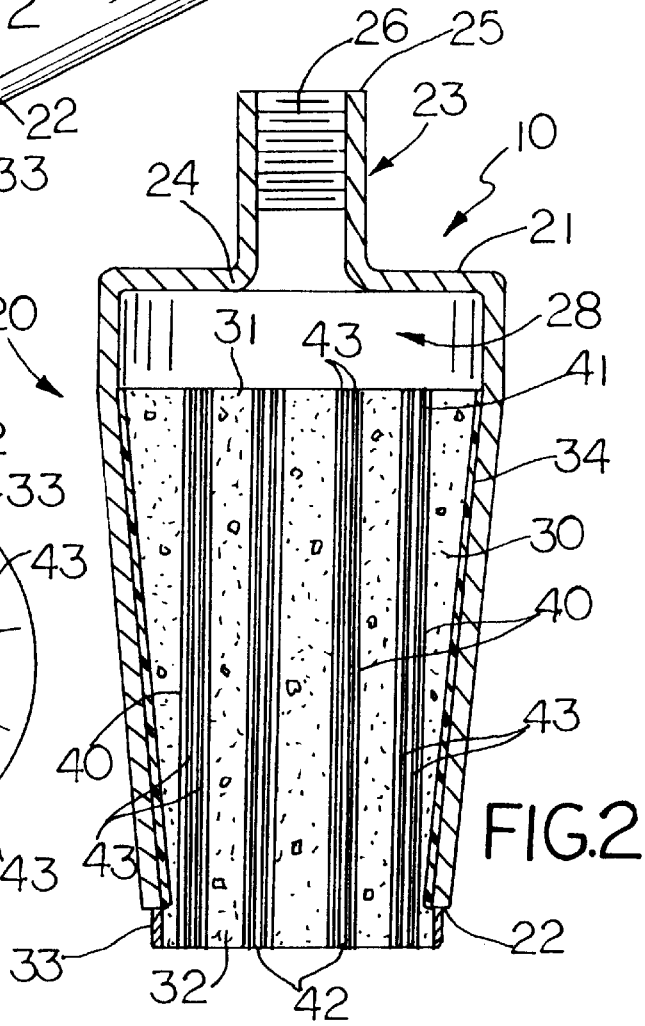
FIG. 2 is a cross-sectional view taken along line 2—2 in FIG. 1.
Figure 3:
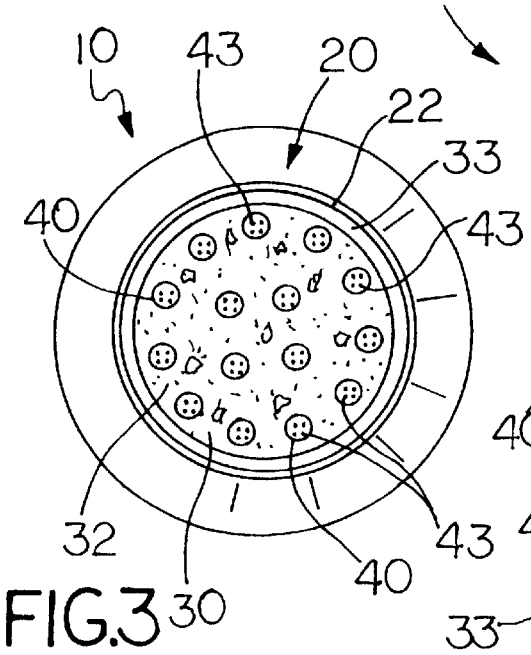
FIG. 3 is an end view of the purging device shown in FIG. 1.

FIG. 1 shows a perspective view of a purging device 10 according to the present invention. Purging device 10 generally includes shell 20, body 30 and gas delivery tubes 40.

Shell 20 is a generally frustocononical member having a first end 21 and a second end 22. An inlet 23 having a first end 24 secured to first end 21 of shell 20 and a second end 25 extends from first end 21 of shell 20. A passageway 26 extends through inlet 23 and is in fluid communication with interior 28 of shell 20. Inlet 23 is provided with internal threads 27. Shell 20 may be formed from a variety of materials, including steel or a refractory material.

Body 30 includes a first end 31 and a second end 32. First end 31 is disposed in shell 20 near first end 21. However, first end 31 does not extend all the way to first end 24 of inlet 23. Rather, there is a gap or plenum above body 30. Second end 32 of body 30 extends below second end 22 of shell 20. A coating 33 of refractory sealant, such as aluminum oxide powder with binder, is disposed about the portion of second end 32 extending from shell 20. Coating 33 seals the junction of second end 22 and body 30. A second coating 34 of refractory sealant, such as a high alumina powder with binder, surrounds the portion of body 30 disposed within shell 20. Coating 34 seals the junction of body 30 and shell 20 within shell 20 and prevents gas from traveling along this junction. Body 30 may be formed from various refractory materials, such as a high alumina, low cement castable refractory.

A plurality of gas delivery tubes 40 extend through body 30. Each tube 40 includes a first end 41 and a second end 42. A plurality of passageways 43 extend through tubes 40. Each passageway 43 is in fluid communication with the gap in shell 20 and with the atmosphere. Passageways 43 are typically less than 0.7 mm in diameter. Tubes 40 may be formed from a variety of materials. However, it is desirable to form them from a nonferrous material or a refractory material, such as alumina or mullite. Ideally, tubes 40 should exhibit thermal expansion and contraction properties similar to those of body 30. This will reduce the possibility that body 30 or tubes 40 will crack or break during use.

To form purging device 10, first end 41 and second end 42 of tubes 40 are dipped in wax to seal passageways 43. Tubes 40 are then placed in a mold and the mold is filled with refractory material to form body 30. After the refractory material hardens, body 30, with tubes 40 disposed therein, is removed from the mold and allowed to cure. Body 30 with tubes 40 disposed therein is then dried in an oven. After drying, body 30 with tubes 40 therein is fired in a kiln. The ends of body 30 and tubes 40 are then ground. Coating 34 is then applied to the portion of body 30 that will be located within shell 20. Shell 20 is then placed around body 30 with tubes 40 disposed therein, afterwhich first end 21 is placed over shell 20 and welded thereto. Inlet 23 is then welded to first end 21. Coating 33 is then applied to the portion of body 30 extending from shell 20.

In operation, inlet 23 of purging device 10 is placed in fluid communication with a gas supply. Threads 27 may be utilized to secure purging device 10 to the desired apparatus. Referring to a lance for purposes of example, the lance with purging device 10 secured thereto is placed in a vessel filled with molten metal and gas, such as argon, flows through the lance, into the plenum above body 30 via inlet 23, through tubes 40 via passageways 43 and out of purging device 10 into the molten metal. In this manner, gas is delivered into the molten metal through a plurality of passageways arranged in discrete groups.

Figure 4:
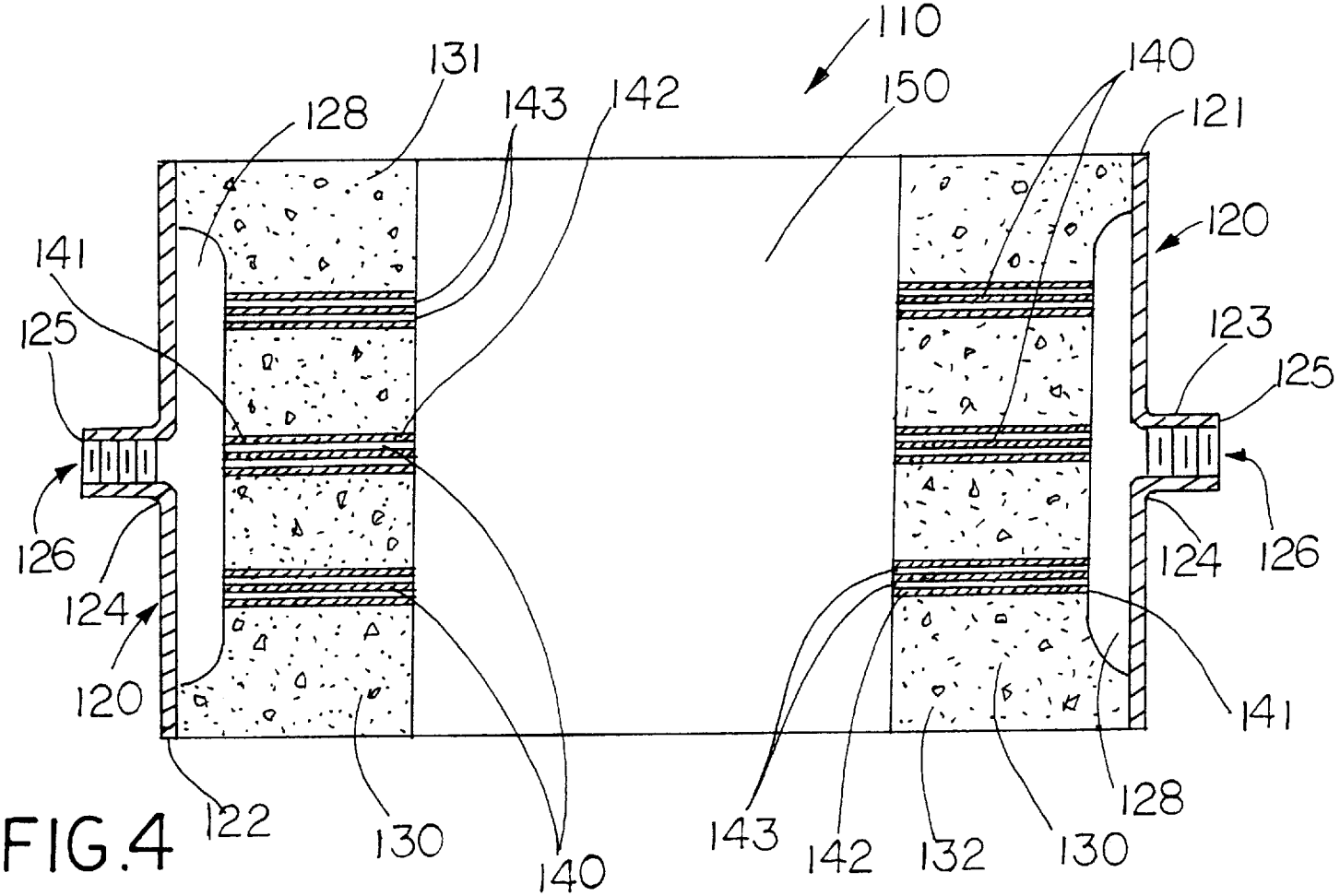
FIG. 4 is a cross-sectional view of an alternative embodiment of a purging device according to the present invention.

FIG. 4 shows a cross-sectional view of an alternative embodiment of a gas purging device according to the present invention. The numeral "1" appears before the remainder of the designation to show correspondence with like parts in the previously described embodiment. In this embodiment, an annular shell 120 is disposed around an annular body 130 such that a plenum 128 exists between shell 120 and body 130. Gas delivery tubes 140 are radially disposed about body 130 and are in fluid communication with central opening 150 of body 130 and plenum 128. Molten metal flows through central opening 150, where it comes in contact with the gases introduced through tubes 140. Note that two inlets 123 are shown, although only one is necessary since plenum 128 is continuous around the circumference of shell 120.

Although the present invention has been illustrated and described in detailed, the same is to be taken by way of example only and not by way of limitation. Various changes can be made to the embodiments shown and described without departing from the scope of the invention. For example, in the first embodiment illustrated, more of body 30 can extend from shell 20 than is shown in the figures. Alternatively, body 30 need not extend beyond second end 22 of shell 20. Similarly, device 10 may be attached to the desired processing equipment by means other than threads 27 in inlet 23. Additionally, shell 20 could be completely eliminated. To do so, body 30 would be cast so as to form a plenum above tubes 40. An inlet would be provided in fluid communication with the plenum. A "lost wax" casting process may be used to form such a device. Accordingly, the scope of the invention is to be limited only by the claims appended hereto.

What is claimed is:

1. A purging device for use in metal processing, comprising:

a shell having an interior surface;

a body disposed in said shell, the body having an end adjacent the interior surface of the shell; and the body end and the interior surface of the shell defining a gap therebetween;

an inlet in fluid communication with the gap; and at least one gas delivery tube disposed in said body, said tube being in fluid communication with the gap and having at least two passageways extending therethrough.

2. The device according to claim 1, further including a gap between said body and said shell.

3. The device according to claim 2, wherein said tubes are formed from a refractory material.

4. The device according to claim 3, wherein said tubes are extruded.

5. The device according to claim 4, wherein a portion of said body extends out of said shell.

6. A purging device for use in processing metal, comprising:

a shell having an interior and an inlet in fluid communication with said interior;

a body disposed within said interior; and a unitary gas delivery tube disposed within the body, the delivery tube being of substantially one-piece construction and having at least two passageways extending therethrough.

7. The device according to claim 6, further comprising a gap between said passageways and said shell.

8. The device according to claim 7, wherein said passageways are formed in tubes and said tubes extend through said body.

9. The device according to claim 8, wherein said tubes comprise a refractory material.

10. The device according to claim 9, wherein said tubes are extruded.

11. A purging device for introducing gas into molten metal during processing, including:

gas delivery means for introducing gas into the molten metal, said gas delivery means including a plurality of passage means arranged in discrete groups; and unitary shell means for containing the gas delivery means, the unitary shell means having an end which narrows to define inlet means for receiving the gas, the inlet means being in fluid communication with the plurality of passage means.

12. The device according to claim 11, further including body means for securing said gas delivery means in said shell means.

13. The device according to claim 11, further including plenum means in fluid communication with said inlet means and said passage means.

14. The device according to claim 11, wherein said gas delivery means includes a tube.

15. The device according to claim 14, wherein said tube is formed from a refractory material.

16. The device according to claim 13, wherein said plenum means includes a gap between said body means and said shell means.

17. A method of making a purging device for use in processing metal, comprising the steps of:

placing a tube having a passageway therethrough in a mold;

filling the mold with refractory material to form a body about the tube;

coating the body with a sealant; and placing the body in a shell.

18. The method according to claim 17, further comprising the step of dipping said tube in wax before inserting it in the mold.

19. The method according to claim 17, further comprising the step of grinding the ends of said body.

20. A purging device for use in metal processing, comprising:

an annular shell having an inlet;

an annular body disposed within the annular shell, the annular body having a central opening; and a gas delivery tube disposed in the annular body, the tube having at least two passageways extending therethrough;

the annular shell and the annular body forming a circumferential gap about the annular body, the gap being in fluid communication with the annular shell inlet and the gas delivery tube.

21. The device according to claim 20 wherein the tube extends radially through the annular body between the gap and the central opening.

22. The device according to claim 20 wherein the annular shell includes a second inlet in communication with the gap.

23. The device according to claim 1 wherein the shell is of one-piece construction and narrows to define the inlet.

24. The device according to claim 6 wherein the shell is of one-piece construction and narrows at one end to define the inlet.

* * * * *